US006679556B1

(12) United States Patent
Alvestad

(10) Patent No.: US 6,679,556 B1
(45) Date of Patent: Jan. 20, 2004

(54) ARRANGEMENT FOR BEDS AND OTHER RECLINING OR SEATING FURNITURE

(76) Inventor: Kjartan Alvestad, N. 6222, Ikornnes (NO)

( * ) Notice: Subject to any disclaimer, the term of this patent is extended or adjusted under 35 U.S.C. 154(b) by 0 days.

(21) Appl. No.: 09/913,606

(22) PCT Filed: Feb. 29, 2000

(86) PCT No.: PCT/NO00/00071

§ 371 (c)(1),
(2), (4) Date: Aug. 16, 2001

(87) PCT Pub. No.: WO00/51469

PCT Pub. Date: Sep. 8, 2000

(30) Foreign Application Priority Data

Mar. 1, 1999 (NO) ..... 19990983

(51) Int. Cl.[7] ..... B60N 2/34

(52) U.S. Cl. ..... 297/354.13; 297/317; 297/342; 297/68

(58) Field of Search ..... 297/362.13, 354.13, 297/68, 342, 317

(56) References Cited

U.S. PATENT DOCUMENTS

| | | | | |
|---|---|---|---|---|
| 3,003,160 A | * | 10/1961 | Goodman | 297/354.13 |
| 3,916,461 A | * | 11/1975 | Kerstholt | 297/354.13 X |
| 4,371,996 A | * | 2/1983 | Nahum | 5/108 |
| 5,342,112 A | * | 8/1994 | Padovan | 297/362.13 |
| 5,498,055 A | * | 3/1996 | Goldman | 297/68 |
| 5,860,701 A | | 1/1999 | Jungjohann et al. | 297/316 |
| 5,868,461 A | * | 2/1999 | Brotherston | 297/354.13 |

FOREIGN PATENT DOCUMENTS

| | | |
|---|---|---|
| DE | 1 779 576 | 2/1972 |
| DE | 29 43 546 | 4/1981 |
| EP | 827 704 A2 | 3/1988 |
| FI | 89867 | 3/1993 |
| NO | 43103 | 10/1926 |
| WO | WO 95/25452 | 9/1995 |
| WO | WO 98/37791 | 9/1998 |

* cited by examiner

*Primary Examiner*—Anthony D. Barfield
(74) *Attorney, Agent, or Firm*—Finnegan, Henderson, Farabow, Garrett & Dunner, L.L.P.

(57) ABSTRACT

In an adjustable arrangement for reclining or seating furniture, where the furniture has two or more mutually adjustable articulated members (R, S, F), which together form an adjustable frame for support of a mattress, cushion, upholstery or the like, where the adjustable frame is mounted in a support member (A) by means of horizontal axles/dowels, stays/sliding elements or the like, which constitute fulcrums (2, 3, 5) for the mutually adjustable, articulated members (R, S, F), where the back member (R) has a fixed fulcrum (2) in relation to the support member (A), located at a distance from the linkage (1) to the seat member, and where the adjustment of the furniture's respective articulated members is performed by means of a spring mechanism (17) which is arranged between an arm (6) on the underside of the back member (R) and a point on the support member (A), the furniture's seat member (S) is designed with an extension member (T, 8, 12) preferably arranged between the seat member and the back member.

5 Claims, 5 Drawing Sheets

Figure 1:
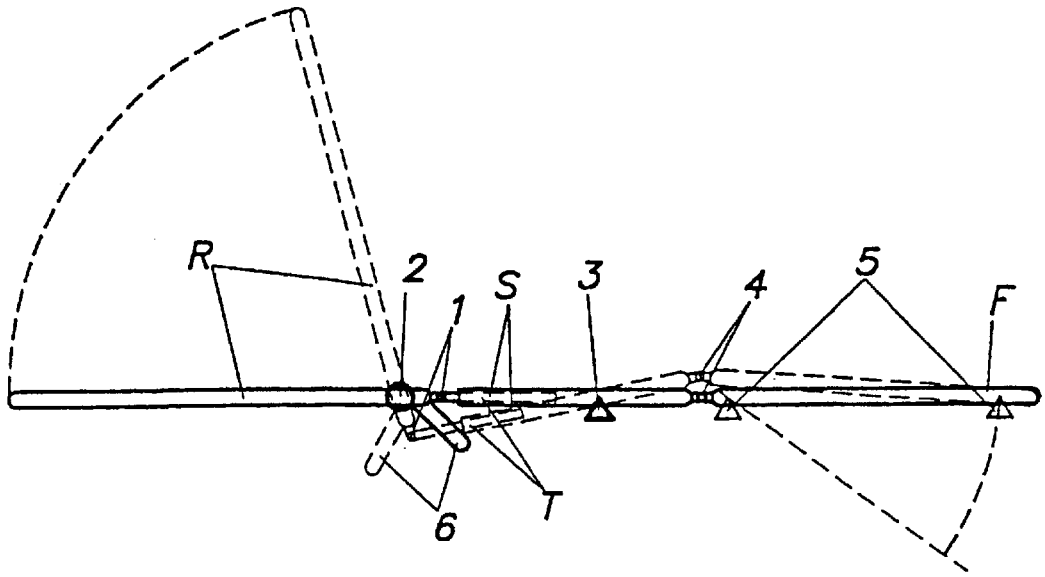

Fig. 3
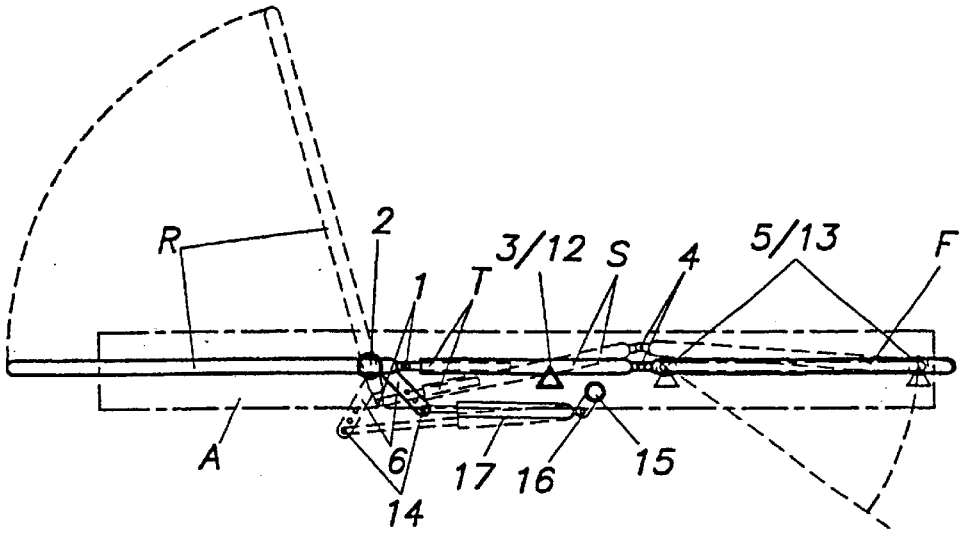
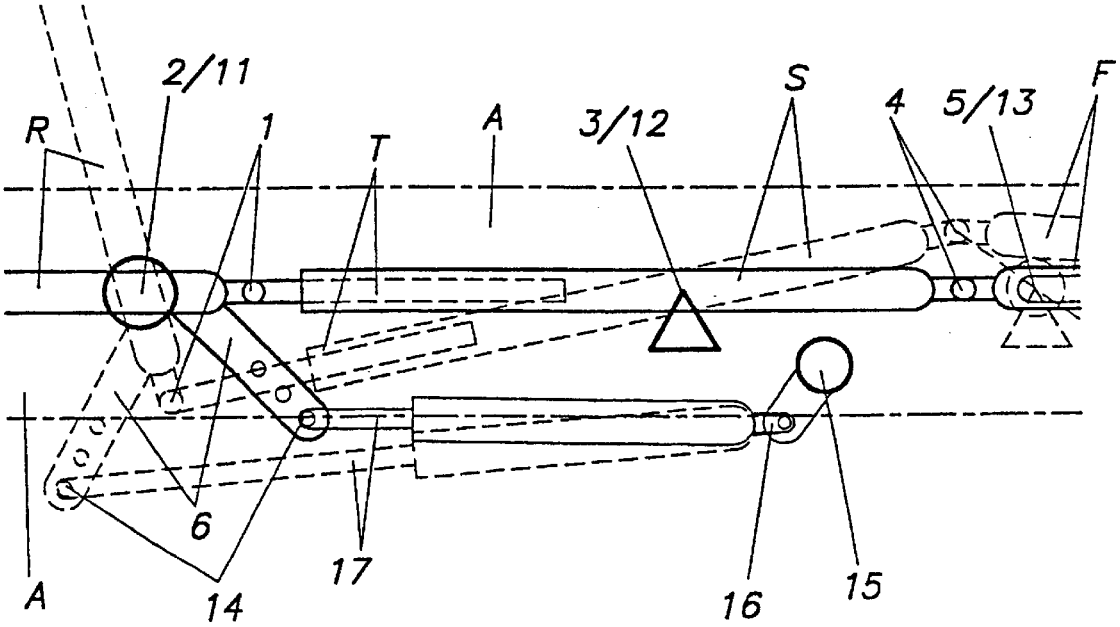
Fig. 4

ARRANGEMENT FOR BEDS AND OTHER RECLINING OR SEATING FURNITURE

The invention concerns an adjustable arrangement for reclining or seating furniture, wherein the piece of furniture has three mutually adjustable, articulated members, constituting a back member (R), a seat member (S) and a foot member (F), which together form an adjustable frame for support of a mattress, cushion, upholstery or the like, where the adjustable frame is mounted in a support member (A) by means of horizontal axles/dowels/stays/sliding elements or the like, which constitute fulcrums (2, 3, 5) for the mutually adjustable, articulated members (R, S, F), where the back member (R) and one of the two other elements (S or F) have a fixed, immovable fulcrum (2) in relation to the support member (A), the fulcrum of the back member being located at a distance from the linkage (1) to the seat member, and by which:

a) the seat member's fulcrum (3) or the foot member's fulcrum (5) is immovable and securely attached to the support member's (A) suspension point (12 or 13), b) the fulcrum (3 or 5) which is not immovable and securely attached to the support member (A) is movable forwards and backwards in the furniture's longitudinal direction in sliding elements/sliding tracks (12 or 13) on the support member (A), The terms reclining or seating furniture describe all types of furniture where it may be appropriate to adjust the user position, e.g. a bed, chaise longue, divan, bench, sofa, chair, etc. The furniture frame, composed of articulated parts, which forms the support for the furniture's upholstery, arrangement of cushions, a mattress or the like, is mounted in a support member, which may be a side member, gable, frame or other fixed components. The terms furniture, frame, support member are used in the following and in the patent claims are based on these definitions. In this connection it should also be noted that the support for the mattress, cushions etc. will naturally also form the support for the user of the furniture.

There are previously known a great number of different designs of adjustable reclining or seating furniture. Examples of such articulated designs can be found in the applicant's international patent applications nos. WO97/37567, WO98/37792 and WO98/37791. Articulated furniture of this kind is widely used within the health sector, e.g. in connection with hospital beds, but is also employed to an ever-increasing extent as ordinary furniture. The adjustments of the furniture's parts to the various user positions may be performed by motor power, which may be electrically, hydraulically or pneumatically driven. Other possibilities are mechanical operation via adjusting levers, or by the user taking hold of a part of the furniture and moving it by hand. In this connection it is referred to Norwegian Patent number 43103. An arrangement with two adjustable members is shown in DE OS number 1 779 576.

The present invention concerns adjustable reclining or seating furniture in which it should be possible to perform the adjustment entirely without or with minimal help from external power sources, while at the same time it should be possible to perform the adjustment of the furniture with a minimal exercise of force, directly by the user while he is reclining/sitting on the piece of furniture. Thus it should be possible to perform a readjustment of the furniture, e.g. from a reclining position to a sitting position and back or to assume intermediate positions, essentially by the user simply performing a "natural movement", with the result that the furniture "follows" when the user readjusts from one position to the other.

In WO 98/37791 an example of this type is described, where a spring mechanism, e.g. a gas spring is adapted in such a manner that a user can alter the angular position between back member, seat member and possibly foot member merely by leaning forward or back against the back member. The furniture can be locked in the desired position by locking the spring mechanism.

When this furniture is used with a cover such as a mattress, in the area between the seat and the back a "compression" will be formed, where the mattress is shifted by a displacement of the seat member, thus producing a certain amount of additional resistance from the mattress, which also has to be overcome.

This can lead to a rather uneven resistance which has to be overcome with the result that the user has to use more force in certain positions.

The object of the present invention is to avoid this problem and provide an embodiment of a piece of furniture of the type mentioned in the introduction, which offers less mattress resistance and thereby a more uniform exercise of force for the user over the area of movement of the whole piece of furniture. This is achieved with an arrangement of the type mentioned in the introduction, which is characterized by the features presented in the patent claims.

By simple means the invention offers the advantage that the seat member can also be rotated about a fixed axis point, possibly with only a small lateral movement, with the result that the mattress's resistance to a change in shape does not affect the movement. In addition the user will also move to a minimal extent in the furniture's longitudinal direction during adjustment, thereby also reducing the requirement for adjustment force. During adjustment the mattress's seat and foot members will thereby be able to remain almost at rest on the adjustment system's approximately immovable seat and foot members on account of, among other things, the user's weight and material friction. The seat member's extension enables the mattress's back portion to bend about the mattress's own almost stationary seat and foot members, thereby only "inching" to a minimal extent in the furniture's longitudinal direction during adjustment.

It will hereby be possible to alter the angle between the back and seat members between 180° and up to approximately 90° while the angle between the seat and foot members may be altered between 180° and up to approximately 220°.

The inventive concept is based on the fact that the seat member is equipped with an extension member which is particularly advantageously arranged between the seat member and the back member. In its simplest form this extension is designed as a rod extension, which is telescopically movable in a tube member of the seat member's frame. The telescopic extension may in itself be a gas spring or an electrical actuator. However, the invention also includes other types of devices for achieving the desired extension, e.g. the extension member may be in the form of a scissors member or a rod which is movable in a guide track on an arm on the bottom of the back member. All such embodiments are intended to fall within the term extension member.

Figure 2A:
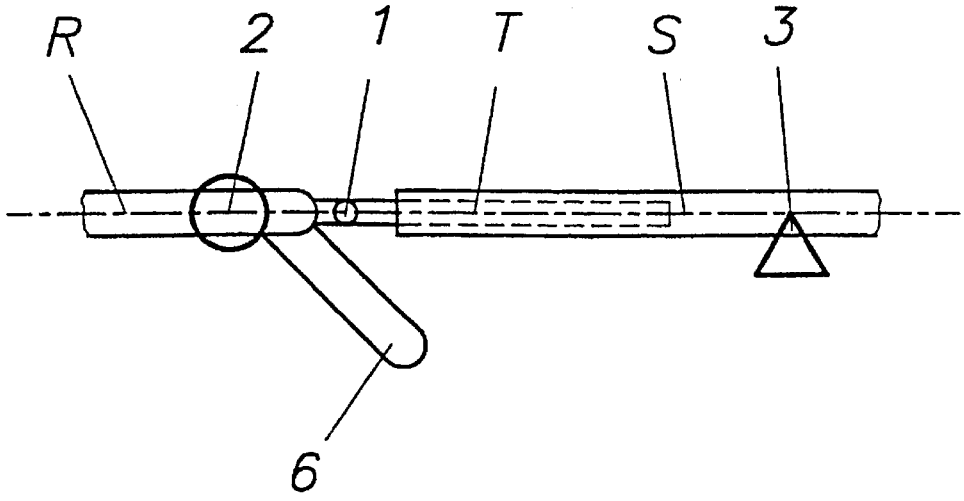
Figure 2B:
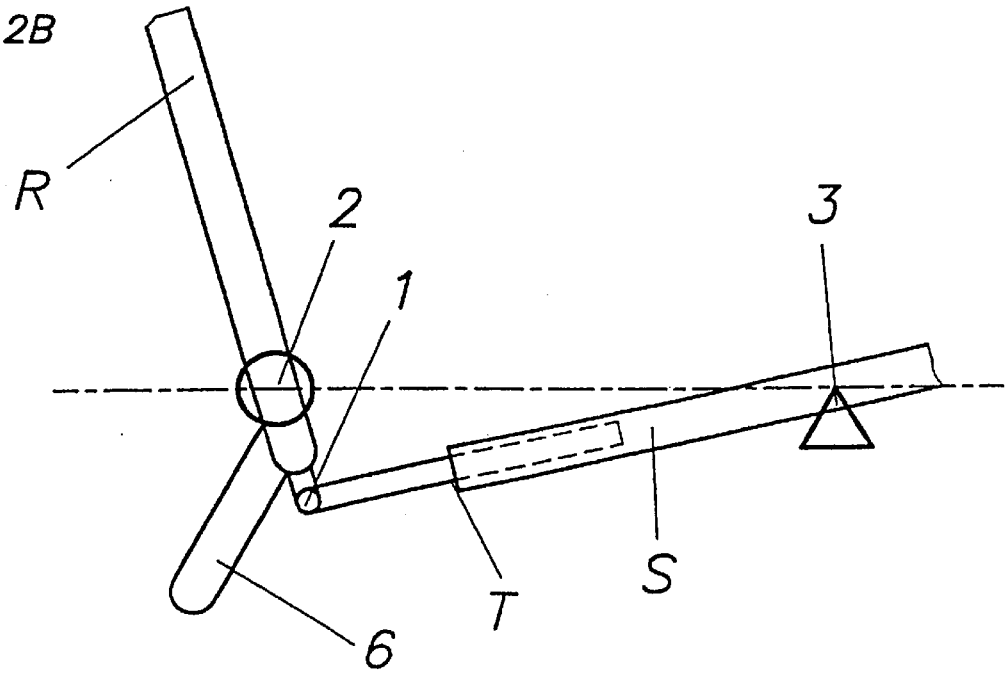
Figure 5A:
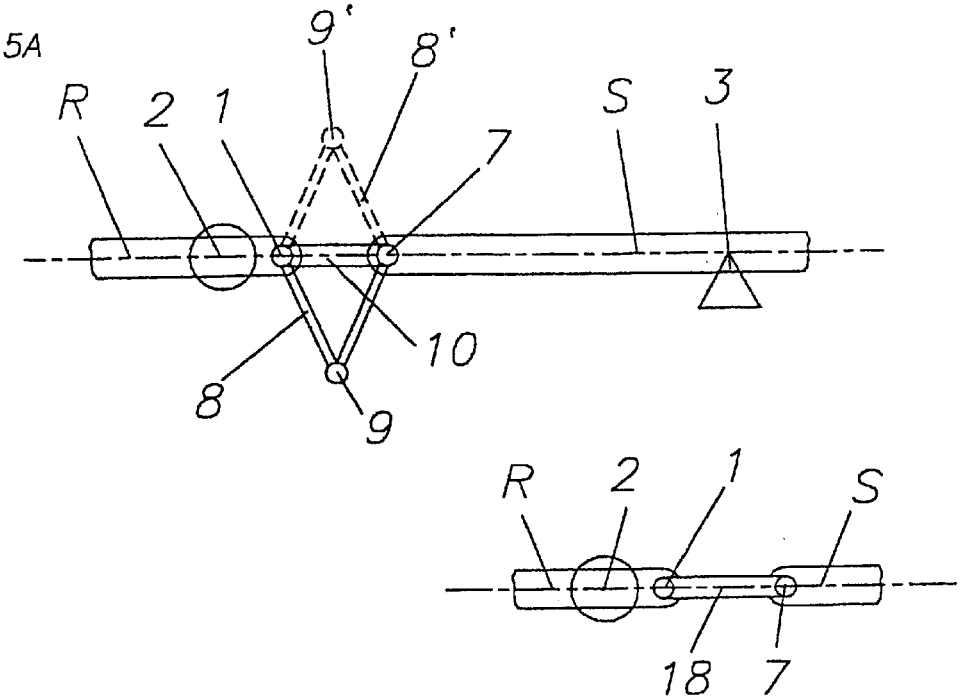
Figure 5B:
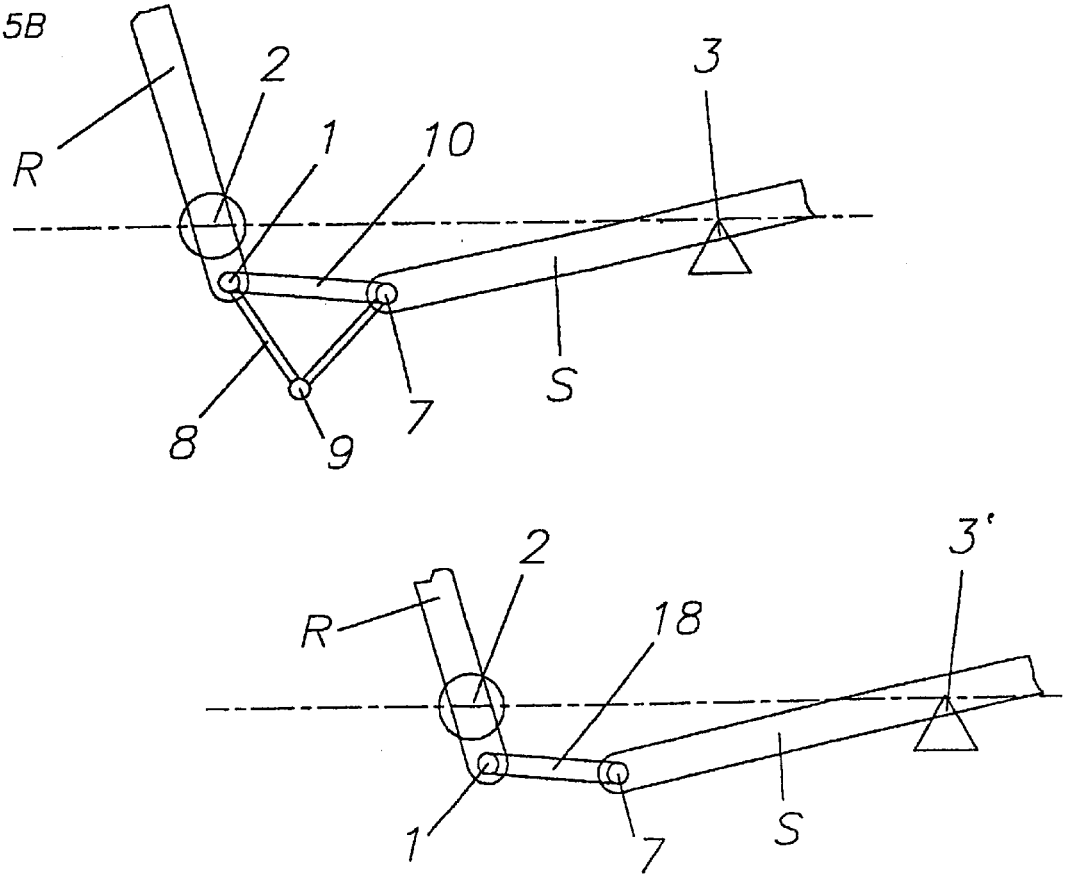
Figure 6A:
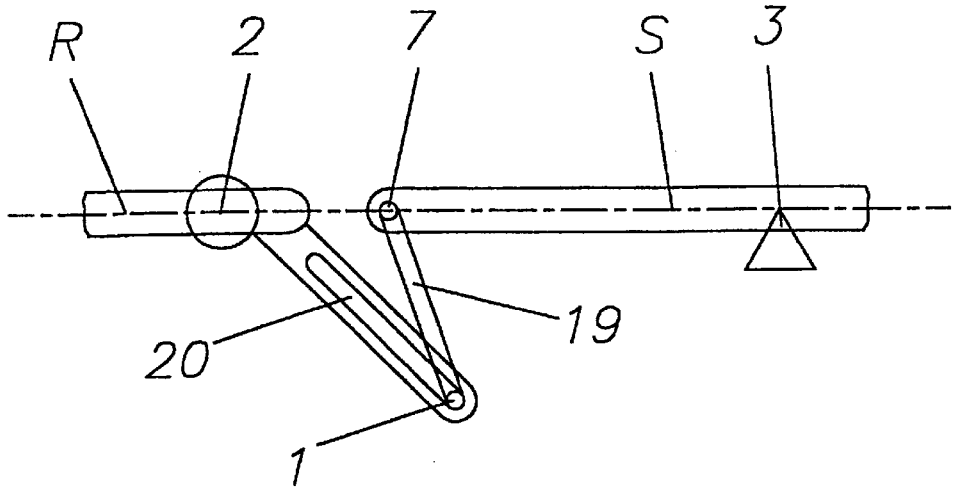
Figure 6B:
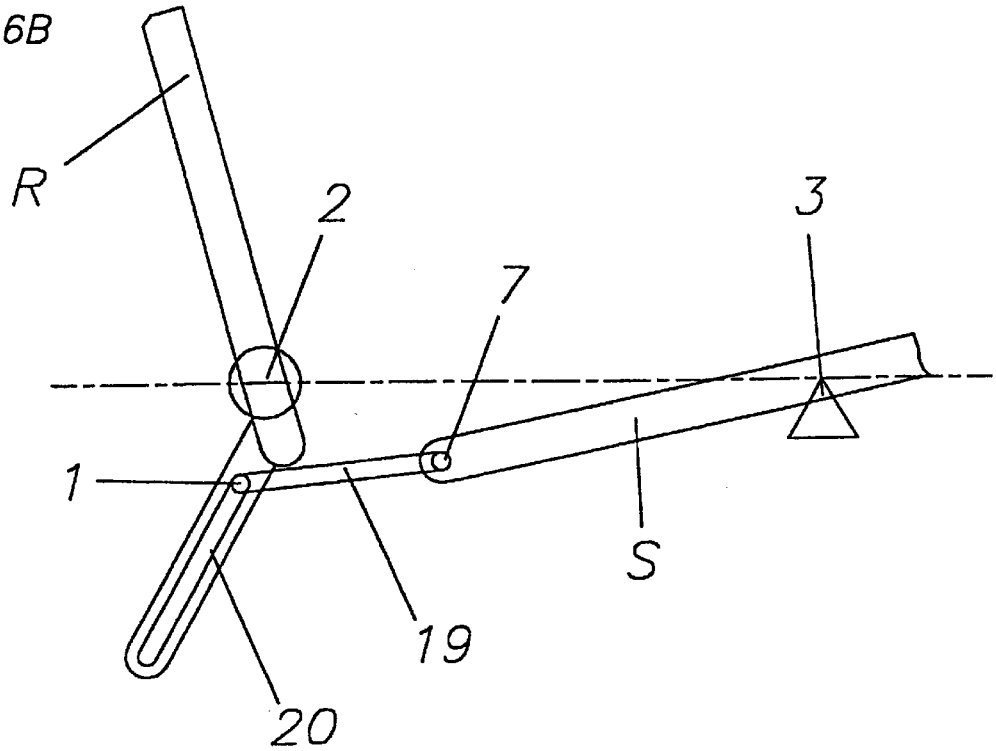

The invention will now be explained in more detail by means of the embodiment which is illustrated in the drawing, in which:

FIG. 1 is a schematic side view of the principles of the present invention in a first embodiment of a piece of reclining furniture, FIGS. 2*a*–2*b* are an enlarged part view illustrating two positions of the embodiment in FIG. 1, FIG. 3 is a view corresponding to FIG. 1, also illustrating the balancing spring mechanism, FIG. 4 is a part view on an enlarged scale of FIG. 3 illustrating various positions in connection with the invention, FIGS. 5*a*–5*b* are a part view of an illustration of a second embodiment of the invention in two alternatives, FIGS. 6*a*–6*b* are a corresponding view of a third embodiment of the invention.

The illustrations in the figures are based on an adjustable frame with articulated parts, based on the principles which are described in WO 97/37567 and equipped with a balancing mechanism of the type which is described in WO 98/3779.1. Details regarding the design of the adjustable piece of furniture and the balancing mechanism are found in the two above-mentioned patent applications.

The furniture's adjustable frame is composed of a back member R, a seat member S and a foot member F. It is also possible to employ the invention on a frame consisting of only two parts, e.g. R and S, or also a frame consisting of more than three parts.

The fulcrums for the three frame members illustrated in the drawing are designated 2, 3 and 5 respectively, while the linkages between back member and seat member and between seat member and foot member respectively are designated 1 and 4. In FIGS. 3 and 4 the frame's support member A is indicated by a dash and dot line. In the area between the back member's fulcrum 2 and the linkage to the seat member S there is provided a downwardly projecting arm 6 which is securely connected with the back member R. This arm forms one of the mountings for the spring mechanism described in international patent application no. WO98/37791, which is omitted in FIGS. 1 and 2. In FIGS. 3 and 4 this spring mechanism in the form of a gas spring is illustrated, but is not described in more detail since the description from the said international patent application is included as a reference. According to a first embodiment of the present invention, in the seat member's frame structure there is inserted a telescopic extension tube, which is designated by T in the drawing. This extension tube T extends from the articulation point 1 and is passed in a tubular element on the seat member S. As illustrated by a dot-dash line the back member R can be raised to a sitting position, thereby causing a rotation of the seat member about the fulcrum 3 which in the illustrated embodiment is a fixed fulcrum. By means of this movement the telescopic rod T will be extended, causing an extension of the seat member. A mattress lying on this frame will thereby remain at rest and will only sink down according to the new frame position. FIGS. 2*a* and 2*b* illustrate this design in an enlarged view.

FIGS. 3 and 4 illustrate in a more complete way the principles for a piece of furniture designed with arrangements according to the invention. Also illustrated here is the position of the balancing cylinder 17 which is attached between a point 14 on the arm 6 and a point on the frame A, which is designated 15 from where an arm can extend to an attachment point 16. Here the gas spring will balance the force which is required for adjustment between the extended position and the position illustrated by a broken line. The movements of the foot member are not described in more detail, since this movement and design do not form part of the present invention, but are described in one of the initially mentioned international patent applications WO97/37567, WO98/37792 and WO98/37791.

FIGS. 5*a* and 5*b* illustrate a variant of the first embodiment, where instead of using a telescopic extension member, an extension member is employed which works according to the scissors principle. In this embodiment an articulated mechanism 8 is used consisting of two arms, connected to back member R at point 1 and to the seat member S at point 7. In order to stabilise the articulated arm mechanism 8, an elastic joint 10 is inserted between points 1 and 7 to control the movement. FIG. 5*b* illustrates the mode of operation for this embodiment.

Alternatives illustrated include a double scissors, where the articulated arm mechanism 8 also has a symmetrical part 8' in the opposite direction, where the joints are connected with one another at point 9'. In this case the elastic joint 10 may be omitted. In a part view there is also illustrated a simplified design, where there is inserted between the back member R and the seat member S a rigid rod element 18 which is rotatable about points 1 and 7, thereby constituting a similar movement arrangement to that in FIG. 5*a*. This design, however, will provide larger angular movements and preferably also exploit a certain amount of horizontal movement of the fulcrum 3.

FIGS. 6*a* and 6*b* illustrate a third embodiment, where rotatable articulated arms are also employed. In this case an arm is provided in the end portion of the back member R and this arm is equipped with a guide track 20. The rotatable articulated arm 19 which leads from point 7 to point 1 will here lead to a controlled extension of the seat member S when the articulated arm's connection point 1 is moved in the track 20. It should be pointed out that this arm will be in addition to the previously mentioned arm 6 for the spring mechanism, the arm 6 advantageously being mounted in the central portion of the frame.

The invention may be designed in many different ways, as illustrated in the embodiments, and it will also be within the scope of the invention if the extension is not undertaken in the end portion of the seat member, but, e.g., in an area located within the end portion, possibly in the portion which is connected to the foot member. The latter variant will require the fulcrum 3 to have a certain amount of movement, while the fulcrum of the foot member can be fixed. In all the embodiments the proposed extension can be combined with a certain amount of horizontal movement of the fulcrum 3 in order to achieve a desired special pattern of rotation of the parts relative to one another.

In all the embodiments it will be possible to alter the angle between the back and seat members between 180° and up to approximately 90° while the angle between the seat and foot members may be altered between 18° and up to approximately 220°.

What is claimed is:

1. An adjustable article of furniture, comprising three mutually adjustable, articulated members, constituting a back member, a seat member and a foot member, connected to each other by means of linkages, and which together form an adjustable support frame, where the adjustable frame is mounted in a support member by means for mounting, which constitute fulcrums for the mutually adjustable, articulated members where the back member and one of the two other elements have a fixed, immovable fulcrum in relation to the support member, the fulcrum of the back member being located at a distance from the linkage to the seat member, the seat member's fulcrum or the foot member's fulcrum is immovable and securely attached to the support member, and the fulcrum which is not immovable is movable forwards and backwards in the furniture's longitudinal direction on the support member, an extension member on the furniture between the seat member and the back member which provides an extension for the furniture having a minimum length when the angle between the back and seat members is 180° and a maximum when the said angle is approximately 90° while the angle between the seat and foot members thereby will be 180°, and approximately 220°, and a spring mechanism between an arm on the bottom of the back member and a point on the support member in order to neutralize and/or overcome the forces which at any time influence the adjustable frame's various connected levers when the user is seated in the article of furniture, in order thereby to be able to move the adjustable frame from one position to another when the user is seated in the article of furniture.

2. An adjustable article of furniture according to claim 1, wherein the extension member is composed of at least one telescopic rod.

3. An adjustable article of furniture according to claim 1, wherein the extension member is composed of a single scissors mechanism on the bottom of the back/seat member and connected to the ends of the back member and the seat member which are facing each other.

4. An adjustable article of furniture according to claim 2, wherein the telescopic extension is provided in the area between the end point of the back member and the fulcrum of the seat member.

5. An adjustable article of furniture, comprising three mutually adjustable, articulated members, constituting a back member, a seat member and a foot member, connected to each other by means of linkages, and which together form an adjustable support frame, where the adjustable frame is mounted in a support member by means for mounting, which constitute fulcrums for the mutually adjustable, articulated members where the back member and one of the two other elements have a fixed, immovable fulcrum in relation to the support member, the fulcrum of the back member being located at a distance from the linkage to the seat member, the seat member's fulcrum or the foot member's fulcrum is immovable and securely attached to the support member, and the fulcrum which is not immovable is movable forwards and backwards in the furniture's longitudinal direction on the support member, an extension member on the furniture between the seat member and the back member which provides an extension for the furniture having a minimum length when the angle between the back and seat members is 180° and a maximum when the said angle is approximately 90° while the angle between the seat and foot members thereby will be 180°, and approximately 220°, a spring mechanism between an arm on the bottom of the back member and a point on the support member in order to neutralize and/or overcome the forces which at any time influence the adjustable frame's various connected levers when the user is seated in the article of furniture, in order thereby to be able to move the adjustable frame from one position to another when the user is seated in the article of furniture, and wherein the extension member includes at least one rod element on the seat member movable in a track in an arm on the bottom of the back member.

* * * * *